US007409173B2

(12) United States Patent
Takemura

(10) Patent No.: US 7,409,173 B2
(45) Date of Patent: Aug. 5, 2008

(54) IMAGE FORMING APPARATUS AND EXHAUST MECHANISM

(75) Inventor: Minoru Takemura, Sagamihara (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 778 days.

(21) Appl. No.: 10/862,471

(22) Filed: Jun. 8, 2004

(65) Prior Publication Data

US 2005/0271413 A1 Dec. 8, 2005

(51) Int. Cl.
*G03G 21/20* (2006.01)

(52) U.S. Cl. ..... 399/92

(58) Field of Classification Search ..... 399/92, 399/400, 405, 401

See application file for complete search history.

(56) References Cited

U.S. PATENT DOCUMENTS 3,901,591 A * 8/1975 Mitsumasu ..... 399/92
5,335,049 A * 8/1994 Kanai et al. ..... 399/92
6,173,132 B1 * 1/2001 Kida et al. ..... 399/92
6,219,497 B1 * 4/2001 Hauman et al. ..... 399/92
6,253,042 B1 * 6/2001 Yang ..... 399/92
6,256,464 B1 * 7/2001 Sumiyoshi
6,714,229 B2 * 3/2004 Miyazaki et al. ..... 399/92
6,954,602 B2 * 10/2005 Kimizuka ..... 399/92
7,209,679 B2 * 4/2007 Kim et al. ..... 399/92

FOREIGN PATENT DOCUMENTS

JP 63284571 A * 11/1988
JP 63307470 A * 12/1988
JP 5-11554 A 1/1993
JP 2001330998 A * 11/2001

* cited by examiner

*Primary Examiner*—Susan S Lee
(74) *Attorney, Agent, or Firm*—Foley & Lardner LLP

(57) ABSTRACT

In an exhaust mechanism of the present invention, an upper surface of a part of a main body case in which exhaust ports are formed is formed into a curved or inclined shape, so that no object can be placed thereon, and therefore, there can be provided an image forming apparatus wherein the exhaust ports are not closed, whereby a constant exhaust efficiency can be maintained, a higher exhaust efficiency can be realized, and safety is improved.

13 Claims, 4 Drawing Sheets

IMAGE FORMING APPARATUS AND EXHAUST MECHANISM

BACKGROUND OF THE INVENTION

1. Field of the Invention

The present invention relates to an image forming apparatus which forms an image on a transfer material by use of an electrophotographic system, and an exhaust mechanism for exhausting heat or the like generated in the image forming apparatus to the outside.

2. Description of the Related Art

In an image forming apparatus in which an electrophotographic system is used, a fixing device which fuses a developer image transferred onto a transfer material to fix the image onto the transfer material, a power supply device which supplies a power to an electric equipment disposed in the apparatus and the like are mounted. The fixing device includes a heating roller which is heated at several hundreds of degrees to fuse a developer.

When other members disposed in the apparatus are heated by heat generated from the fixing device and the power supply device and accumulated in the apparatus without being exhausted to the outside, a problem occurs that the electric equipment malfunctions or that the characteristics of the toner change due to temperature.

For example, in Jpn. Pat. Appln. KOKAI Publication No. 5-11554 (U.S. Pat. No. 5,335,049), an image forming apparatus is described in which an exhaust mechanism is protruded from a main body frame, and an exhaust port can be maintained even in a case where a main body is disposed in the vicinity of a wall or the like or an object is disposed at the exhaust port. The apparatus will be described in detail. In the apparatus, a fan for exhaust is disposed in the apparatus, and a large number of slit-shaped exhaust ports are formed in the exhaust mechanism having a substantially spherical section. By this constitution, even when an object is placed at the exhaust ports, the exhaust ports are prevented from being completely closed, and can be secured.

However, when continuous image formation is instructed in the image forming apparatus, and a copying operation or the like is continuously executed, the temperature becomes very high in the apparatus. In this case, when an object is placed at the exhaust ports and is not moved, an exhaust performance degrades even in a state in which the exhaust ports are not completely closed. The heat in the apparatus is not sufficiently exhausted, and the temperature rises in the apparatus in some case. This causes a problem that the electric equipment disposed in the apparatus malfunctions or fails.

BRIEF SUMMARY OF THE INVENTION

According to an aspect of the present invention, there is provided an exhaust mechanism which is disposed in a region of a part of a main body case housing an image forming section therein which transfers a developer image constituted of a developer onto an image medium, and fuses the transferred developer image to fix the image onto the image medium, thereby forming an image on the image medium, the exhaust mechanism comprising an exhaust port which exhausts heat generated inside vertically upward, and an upper surface, on which no object can be placed.

According to another aspect of the present invention, there is provided an image forming apparatus comprising:

an image forming section which transfers a developer image constituted of a developer onto an image medium, and fuses the transferred developer image to fix the image onto the image medium, thereby forming an image on the image medium; and a main body case housing the image forming section therein, and including an exhaust mechanism in which an exhaust port is formed to exhaust heat generated inside vertically upward, the exhaust mechanism including an upper surface which is formed into a curved or inclined shape.

According to further another aspect of the present invention, there is provided an image forming apparatus comprising:

an image forming section which transfers a developer image corresponding to a specific image onto an image medium, and fuses the transferred developer image to fix the image onto the image medium, thereby forming an image on the image medium;

a main body case housing the image forming section therein, and including an exhaust port which exhausts heat generated inside vertically upward; and an exhaust mechanism having a plurality of ribs whose upper surfaces are formed into curved or inclined shapes.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

First Embodiment

Figure 1:
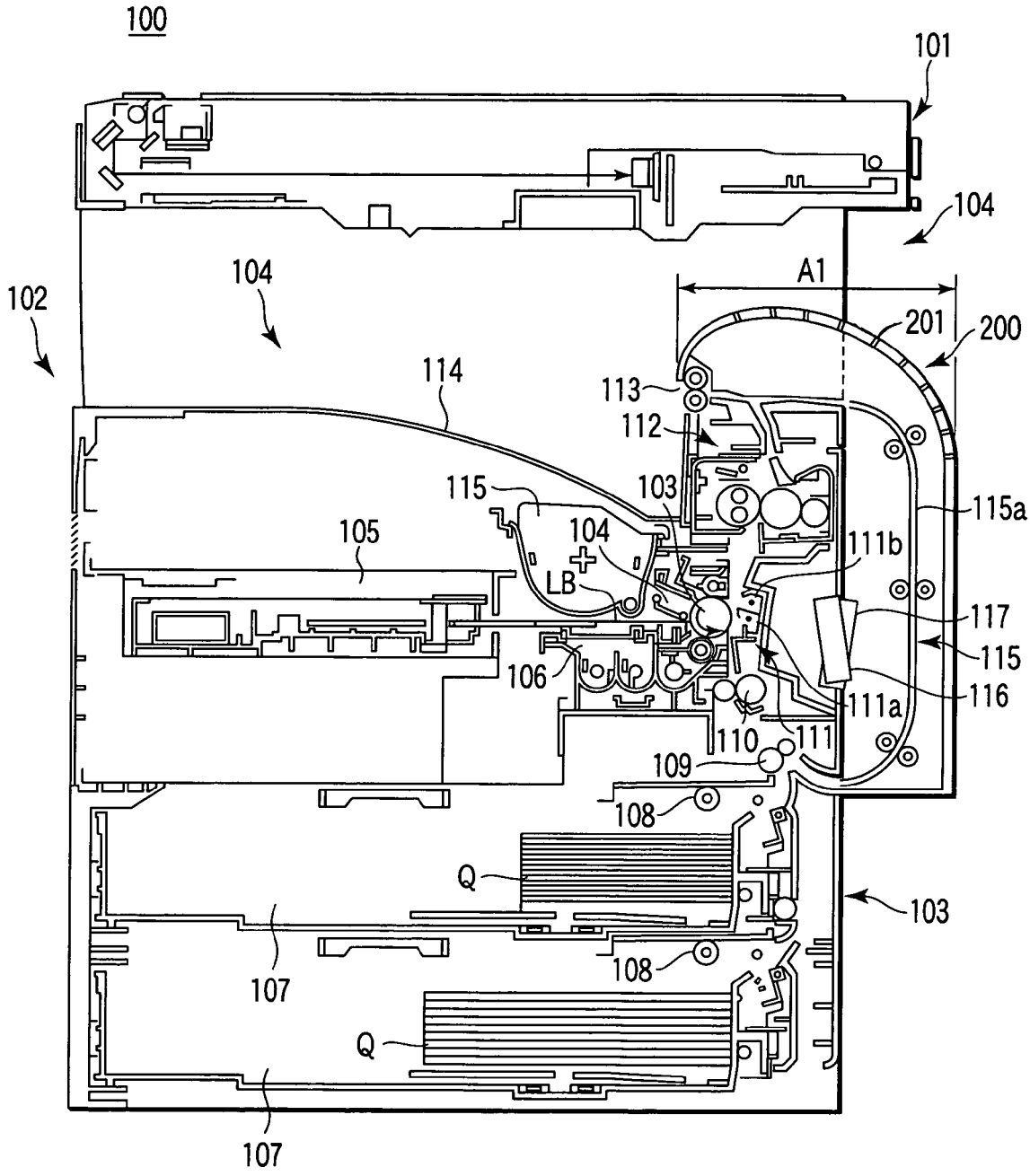
FIG. 1 is a schematic diagram showing an image forming apparatus to which an embodiment of the present invention is applicable.

An example of an image forming apparatus to which an embodiment of the present invention is applied will be described hereinafter with reference to the drawing.

FIG. 1 is a schematic sectional view of an image forming apparatus to which the embodiment of the present invention is applicable as viewed from a front side.

As shown in FIG. 1, a digital copying apparatus 100, which is an image forming apparatus, includes: an image reader (scanner) 101 which reads an image of a reading or copying object (draft) P to produce an image signal; an image forming section 102 which forms an image based on an image signal output from the scanner 101 or an image signal supplied from the outside; and a main body case 103 in which the image forming section 102 is housed. The digital copying apparatus 100 includes a space 104 capable of disposing a medium on which the image has been formed between the scanner 101 and the image forming section 102. The apparatus further includes an exhaust mechanism 200 whose upper surface communicates with the space 104.

In the exhaust mechanism 200, a plurality of exhaust ports 201 are formed for exhausting heat or the like generated from the image forming section 102 housed therein vertically upward.

The image forming section 102 includes a photosensitive drum (image carrier) 103, an electric charger 104, an exposure device 105, a developing device 106, sheet cassettes 107, pickup rollers 108, a conveying roller 109, an aligning roller 110, a transfer device 111, a fixing device 112, a sheet discharge roller 113, a sheet discharge tray 114, an image medium reversing device (automatic double-surface unit) 115, a peeling assistant fan 116, and an exhaust fan 117.

The photosensitive drum 103 includes a photosensitive body on an outer peripheral surface. When light is applied to the photosensitive body in a state in which a predetermined potential is supplied, the potential of a region irradiated with the light changes, and the change of the potential can be held as an electrostatic image by the body for a certain time.

The electric charger 104 charges the surface of the photosensitive drum 103 at a predetermined potential.

The exposure device 105 is positioned on a downstream side of a rotation direction of the photosensitive drum 103 from the electric charger 104, and the photosensitive drum 103 is exposed to a laser beam LB whose light intensity is changed in accordance with the image signal of a specific image supplied from the scanner 101.

The developing device 106 is positioned on the downstream side of the rotation direction of the photosensitive drum 103 from the exposure device 105, stores a two-component developer constituted of carrier and toner, and supplies the developer (toner) to the surface of the photosensitive drum 103. Accordingly, a latent image on the surface of the photosensitive drum 103 is visualized to form a developer image (toner image).

Sheets Q are stored as image mediums in the sheet cassettes 107, taken out sheet by sheet by the pickup rollers 108, and conveyed to the aligning roller 110 by the conveying roller 109.

The aligning roller 110 rotates at a predetermined timing, and conveys the sheet Q to a transfer position in order to match the position of the sheet Q with that of the toner image formed on the photosensitive drum 103.

The transfer device 111 includes: a transfer charger 111*a* which applies a predetermined potential to the sheet Q conveyed to the transfer position to transfer the toner image on the photosensitive drum 103 onto the sheet Q; and a peeling charger 111*b* which weakens electric coupling between the photosensitive drum 103 and the sheet Q to easily peel the sheet Q from the photosensitive drum 103. Further in the vicinity of the peeling charger 111*b*, a peeling auxiliary fan is disposed to discharge air on the side of the photosensitive drum 103 toward the automatic double-surface unit 115 and to peel the sheet Q from the photosensitive drum 103.

The fixing device 112 includes a heating roller heated at several hundreds of degrees and a pressurizing roller which supplies a pressure to the heating roller, and supplies heat and pressure to the sheet Q passing between the heating roller and the pressurizing roller. Accordingly, the toner image held on the sheet Q is fused and fixed to the sheet Q.

The sheet discharge roller 113 conveys the sheet Q discharged from the fixing device 112 to the sheet discharge tray 114.

The automatic double-surface unit 115 passes the sheet Q discharged from the fixing device 112 through a conveying path 115*a*, reverses the sheet in such a manner that a surface opposite to a surface on which the image is formed faces the photosensitive drum 103 as described above, and guides the sheet to the transfer position. The toner image corresponding to a specific image is transferred to the sheet Q which has reached the transfer position. The toner image on the sheet Q is fused and fixed by the fixing device 112, and discharged to the sheet discharge tray 114 via the sheet discharge roller 113.

The exhaust fan 117 includes a constitution in which air in the apparatus is guided above the apparatus and the heat or the like in the apparatus is exhausted from the exhaust ports 201 of the exhaust mechanism 200.

The exhaust mechanism 200 is formed integrally with the main body case 103, contacts the space 104, and covers the fixing device 112 and automatic double-surface unit 115 disposed below. That is, the exhaust mechanism 200 has a range defined by a length A1 shown in FIG. 1 and a length B1 shown in FIG. 2, and an upper surface of the exhaust mechanism 200 including this range is entirely formed in a curved surface, and does not include any horizontal portion. In other words, the upper surface of the exhaust mechanism 200 is formed such that anything placed thereon falls off.

Figure 2:
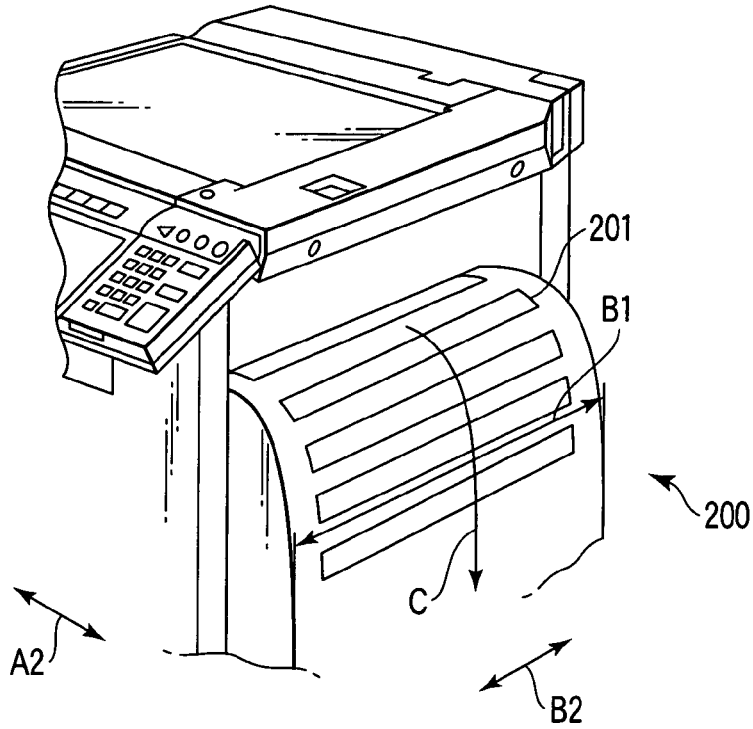
FIG. 2 is a schematic perspective view showing an exhaust mechanism of an image forming apparatus shown in FIG. 1.

The mechanism will be described in more detail with reference to FIG. 2. The upper surface of the exhaust mechanism 200 of the present embodiment is formed in a shape including a straight line having an arrow B2 direction and a curved line having a specific curvature in an arrow A2 direction. The specific curvature has such a degree that an object falls when placed on the exhaust mechanism 200, and is set in accordance with a size of the main body case or a range of the exhaust mechanism 200. The upper surface of the exhaust mechanism 200 has a certain curvature in the arrow B2 direction. That is, as shown in FIG. 1, as viewed from the front side, the line of upper surface of the exhaust mechanism 200 accord.

Therefore, when an object is placed on the mechanism, the placed object falls as shown by an arrow C by its own weight. The exhaust mechanism 200 has a constitution in which no object can be placed thereon.

The exhaust ports 201 are openings elongated in the arrow B2 direction, and guide heat inside the exhaust mechanism 200 to the outside. As described above, the exhaust mechanism 200 has a constitution in which no object can be placed thereon. Therefore, the exhaust ports 201 cannot be blocked by any object or the like, and an exhaust efficiency determined by an opening area of the exhaust port is kept constant. It is to be noted that the exhaust mechanism 200 of the present invention is not limited to the shapes of the exhaust ports 201 shown in FIG. 2, and may have, for example, openings elongated in the arrow A2 direction or hole openings.

Moreover, the exhaust mechanism 200 having the curved surface is not limited to this shape, and may also have, for example, a semicircular shape as viewed from the front side, or a convex shape including curved lines having specific curvatures both in arrows A2, B2 directions. Also in this case, the curvature is such that any object falls when placed on the exhaust mechanism 200, and the upper surface does not include any horizontal portion.

Accordingly, for example, even if a user places a cup containing a drink on the exhaust mechanism 200, the upper surface of the exhaust mechanism 200 has an unstable shape, and the user has a sense of incongruity in placing the object, and is thus prevented from placing the object on the upper surface. Even if the user places paper, a book or the like on the exhaust mechanism 200, the thing falls downwards. A situation in which the object is perpetually placed on the exhaust ports 201 is avoided, and the exhaust efficiency can be prevented from dropping.

Second Embodiment

Next, an example of an exhaust mechanism having an inclined upper surface will be described with reference to FIGS. 3, 4, 5.

Figure 3:
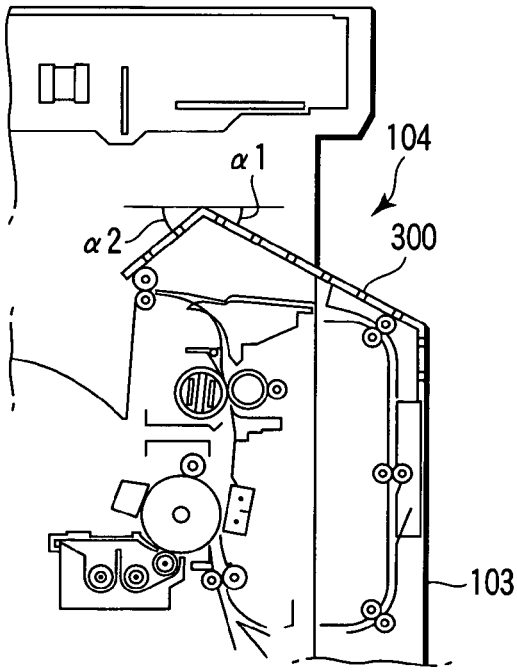
FIG. 3 is a schematic diagram showing an example of the exhaust mechanism different from that shown in FIGS. 1 and 2.
Figure 4:
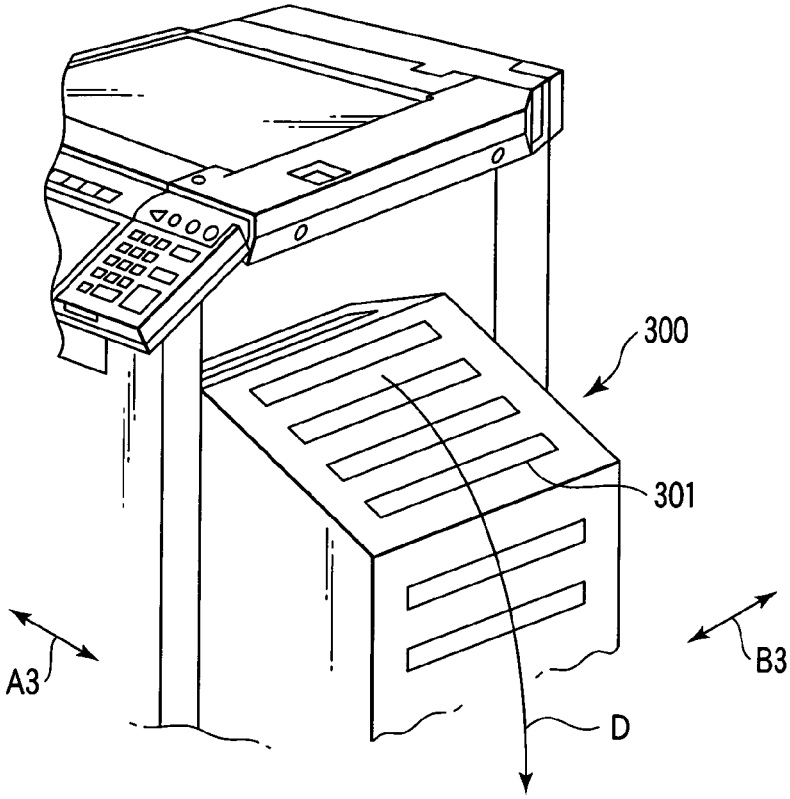
FIG. 4 is a schematic perspective view showing the exhaust mechanism shown in FIG. 3.

As shown in FIGS. 3, 4, in the same manner as in the exhaust mechanism 200, an exhaust mechanism 300 of the present embodiment is formed integrally with the main body case 103, contacts the space 104, and covers the fixing device 112 and automatic double-surface unit 115. In the exhaust mechanism 300, a plurality of exhaust ports 301 for exhausting heat or the like generated from the image forming section 102 housed inside the mechanism are formed.

The upper surface of the exhaust mechanism 300 is formed in an inclined surface, and does not include any horizontal portion. That is, the upper surface of the exhaust mechanism 300 is formed in an inclined surface having inclination angles $\alpha 1$, $\alpha 2$ to such an extent that an object placed on the upper surface falls. Therefore, when an object is placed on the surface, an object falls as shown by an arrow D by its own weight. The exhaust mechanism 300 has a constitution in which no object can be placed thereon.

Figure 5:
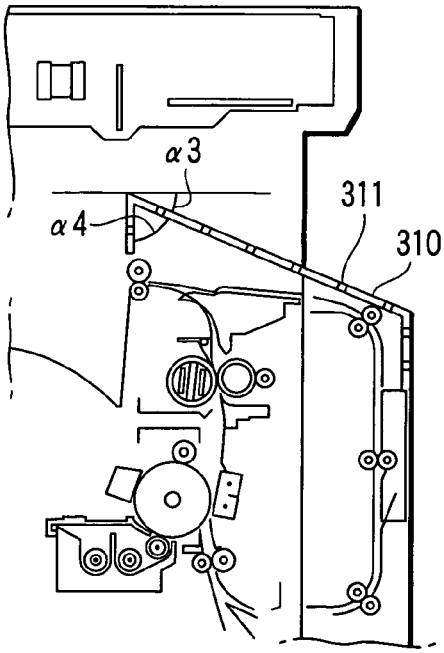
FIG. 5 is a schematic diagram showing a modification of the exhaust mechanism shown in FIGS. 3 and 4.

Moreover, the exhaust mechanism having the inclined surface of the present embodiment may also have an exhaust mechanism 310 configuration as shown in FIG. 5.

The upper surface of the exhaust mechanism 310 is formed inclined, having an inclination angle $\alpha 3$ to such an extent that an object falls when placed on the surface. That is, the upper surface of the exhaust mechanism 310 is an inclined surface having one inclination angle.

As described above, since the exhaust mechanism 300 shown in FIGS. 3, 4 have two inclination angles $\alpha 1$, $\alpha 2$, there is an advantage that a height of a vertex of the inclined surface, that is, the upper surface is suppressed. Since the exhaust mechanism 310 shown in FIG. 5 has an acuter angle $\alpha 4$ of the vertex of the inclined surface, an object placed on the surface easily falls. Moreover, since the upper surface has an unstable configuration, there is an advantage that a user has a sense of incongruity in placing an object, and is prevented from placing an object on the upper surface.

Therefore, the exhaust mechanisms 300, 310 are constituted in such a manner that no object can be placed on the mechanisms. Therefore, the exhaust ports 301, 311 cannot be blocked by any object or the like, and the exhaust efficiency is kept constant.

It is to be noted that the inclined surfaces of the exhaust mechanisms 300, 310 overlap on one straight line as viewed from the front side as shown in FIGS. 3, 5. That is, the upper surface is convex in an arrow A3 direction, and remains unchanged in an arrow B3 direction.

Third Embodiment

Next, an example of the exhaust mechanism including an upper surface formed in a curved or inclined surface and having a plurality of ribs will be described with reference to FIGS. 6, 7.

Figure 6:
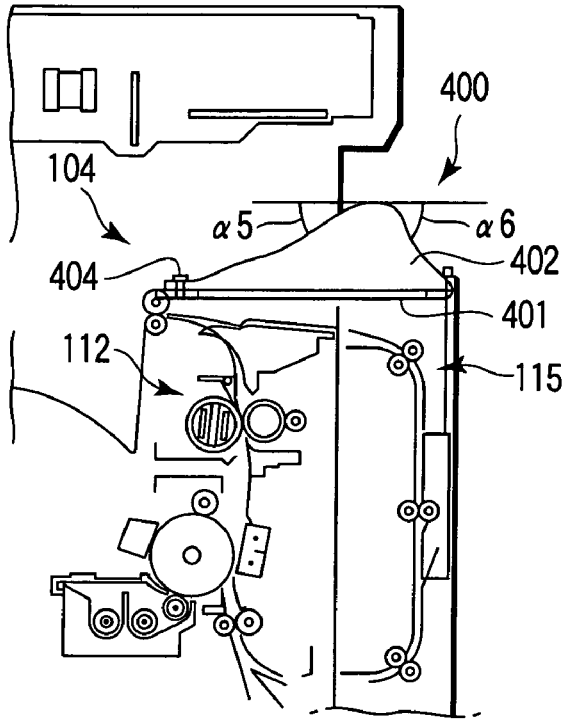
FIG. 6 is a schematic diagram showing an example of the exhaust mechanism different from that shown in FIGS. 1 to 5.
Figure 7:
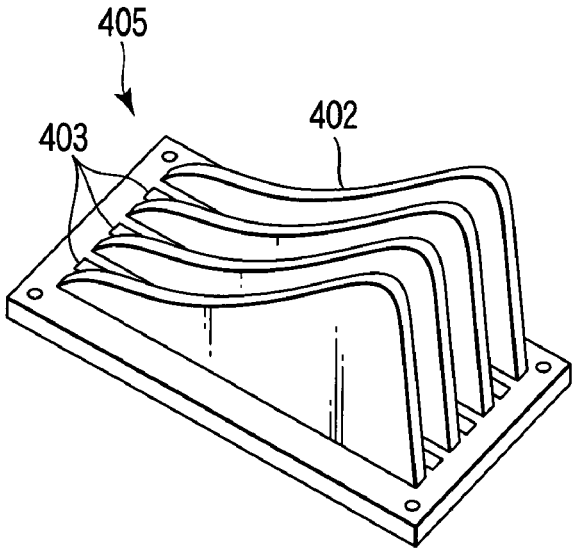
FIG. 7 is a schematic perspective view showing a part of the exhaust mechanism shown in FIG. 6.

As shown in FIGS. 6, 7, in the same manner as in the exhaust mechanism 200, an exhaust mechanism 400 of the present embodiment is formed integrally with the main body case 103, communicates with the space 104, and covers the fixing device 112 and automatic double-surface unit 115. The exhaust mechanism 400 includes: a plurality of exhaust ports 401 for exhausting heat or the like generated from the image forming section 102 housed inside; and a plurality of ribs 402 formed among the exhaust ports 401. This will be described in detail. A rib structure 405 constituted of the ribs 402 and exhaust port portions 403 formed in positions facing the exhaust ports 401 as shown in FIG. 7 is fixed to the main body case 103 by fixing members (e.g., screws) 404 in a predetermined manner.

As shown in FIG. 6, the plurality of ribs 402 are formed in the same shape in such a manner that the shapes of the upper surfaces of the ribs overlap with one another as viewed from the front side as shown in FIG. 6. That is, the upper surfaces of the plurality of ribs 402 are formed in inclined surfaces having inclination angles $\alpha 5$, $\alpha 6$ to such an extent that an object placed on the upper surfaces falls, and do not include any horizontal portion. Therefore, when an object is placed on the surfaces, the object falls by its own weight. The exhaust mechanism 400 has a constitution in which no object can be placed thereon.

Moreover, although not shown, the exhaust mechanism 400 of the present embodiment may also be constituted of a plurality of ribs formed in shapes having predetermined curvatures, and a plurality of exhaust ports formed among the plurality of ribs, so that the upper surface is a curved surface having a predetermined curvature as described with reference to FIGS. 1, 2.

Therefore, the exhaust mechanism 400 is constituted in such a manner that no object can be placed on the mechanism, the exhaust ports 401 are not blocked by any object or the like, and the exhaust efficiency is kept constant. The rib structure 405 shown in FIG. 7 is detachably attached, and may therefore be used in a conventional exhaust mechanism having a flat upper surface.

Moreover, the ribs 402 fulfill functions of heat sinks, the exhaust mechanism 400 can secure a larger heat radiating area, and a heat radiating efficiency is therefore enhanced.

It is to be noted that the present invention is not limited to the present embodiment, and for example, the rib structure 405 shown in FIG. 7 may also be formed integrally with the main body case 103.

As described above, according to the present invention, the upper surface of the main body case in a region where the exhaust ports are formed is formed in a curved or inclined surface to form a constitution in which no object can be placed thereon, and accordingly no exhaust port is blocked. Therefore, a certain exhaust efficiency can be maintained. There can be provided an image forming apparatus in which a higher exhaust efficiency can be realized and safety is enhanced as compared with a state in which an object is placed on the exhaust ports, which partially blocks the exhaust ports.

What is claimed is:

1. An exhaust mechanism which is disposed in a region of a part of a main body case of an image forming apparatus, comprising:

an exhaust port which exhausts heat generated inside vertically upward; and an upper surface, on which no object can be placed;

wherein the main body case houses an image forming section therein which transfers a developer image constituted of a developer onto an image medium, a fixing device which fuses the developer to fix the image onto the image medium, and an image medium reversing device which conveys the image medium including one surface having on the image already formed thereon to a transfer position in order to fix on image onto the opposite surface of the image medium, the fixing device being disposed under the exhaust mechanism, and the image medium reversing device being covered with the exhaust mechanism.

2. The exhaust mechanism according to claim 1, wherein the upper surface is formed into a curved surface over the whole surface.

3. The exhaust mechanism according to claim 1, wherein the upper surface is formed into an inclined surface which does not include any horizontal portion.

4. The exhaust mechanism according to claim 2, wherein the curved surface has a semicircular shape as viewed from a front side of the image forming apparatus, or a convex shape.

5. The exhaust mechanism according to claim 3, wherein the upper surface includes two inclined surfaces.

6. An image forming apparatus comprising:

an image forming section which transfers a developer image constituted of a developer onto an image medium;

a main body case housing the image forming section therein, and including an exhaust mechanism in which an exhaust port is formed to exhaust heat generated inside vertically upward, the exhaust mechanism including an upper surface which is formed into a curved or inclined shape;

a fixing device which is disposed under the exhaust mechanism and which fuses the developer to fix an image onto an image medium; and an image medium reversing device which conveys the image medium including one surface having an image already formed thereon to a transfer position in order to fix the image onto the opposite surface of the image medium, the image medium reversing device being covered with the exhaust mechanism.

7. The image forming apparatus according to claim 6, wherein the upper surface of the exhaust mechanism does not include any horizontal portion over a whole region.

8. The image forming apparatus according to claim 6, wherein the curved shape has a semicircular shape as viewed from an front side of the image forming apparatus, or a convex shape.

9. The image forming apparatus according to claim 6, wherein the inclined shape includes two inclined surfaces.

10. An image forming apparatus comprising:

an image forming section which transfers a developer image corresponding to a specific image onto an image medium;

a main body case housing the image forming section therein, and including an exhaust port which exhausts heat generated inside vertically upward;

an exhaust mechanism having a plurality of ribs whose upper surfaces are formed into curved or inclined shapes;

a fixing device which is disposed under the exhaust mechanism and which fuses the developer to fix an image onto an image medium; and an image medium reversing device which conveys the image medium including one surface having an image already formed thereon to a transfer position in order to fix the image onto the opposite surface of the image medium, the image medium reversing device being covered with the exhaust mechanism.

11. The image forming apparatus according to claim 10, wherein the exhaust port is formed between the plurality of ribs.

12. The image forming apparatus according to claim 10, wherein the ribs constitute heat sinks.

13. The image forming apparatus according to claim 10, wherein the ribs are formed integrally with the main body case.

* * * * *